US008875941B2

(12) United States Patent
Crabill

(10) Patent No.: US 8,875,941 B2
(45) **Date of Patent: *Nov. 4, 2014**

(54) FLEXIBLE SHEET MATERIAL DISPENSER

(71) Applicant: Craig L. Crabill, Sturgis, MI (US)

(72) Inventor: Craig L. Crabill, Sturgis, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/017,403

(22) Filed: Sep. 4, 2013

(65) Prior Publication Data

US 2014/0001197 A1 Jan. 2, 2014

Related U.S. Application Data

(63) Continuation of application No. 13/155,880, filed on Jun. 8, 2011, now Pat. No. 8,534,496.

(60) Provisional application No. 61/352,522, filed on Jun. 8, 2010.

(51) Int. Cl.

| | |
|---|---|
| ***A47K 10/42*** | (2006.01) |
| ***B65D 83/08*** | (2006.01) |
| ***B65D 5/02*** | (2006.01) |
| ***B65D 5/36*** | (2006.01) |
| *A47K 10/32* | (2006.01) |

(52) U.S. Cl.

CPC ..... *A47K 10/421* (2013.01); *B65D 83/0805* (2013.01); *B65D 5/0209* (2013.01); *A47K 2010/3233* (2013.01); *B65D 5/3614* (2013.01)

USPC ..... 221/64; 221/33; 221/305

(58) Field of Classification Search

USPC ..... 221/34, 35, 64, 305

See application file for complete search history.

(56) References Cited

U.S. PATENT DOCUMENTS

| | | | | |
|---|---|---|---|---|
| 3,197,062 | A * | 7/1965 | Day Winterton | 221/48 |
| 4,616,767 | A * | 10/1986 | Seido | 221/58 |
| 6,296,143 | B1 * | 10/2001 | Ghabriel | 221/34 |
| 7,140,492 | B2 * | 11/2006 | Julius | 206/494 |
| 7,219,815 | B2 * | 5/2007 | Shannon et al. | 221/305 |
| 7,401,711 | B2 * | 7/2008 | Spivey, Sr. | 221/305 |

* cited by examiner

*Primary Examiner* — Timothy Waggoner

(74) *Attorney, Agent, or Firm* — Larry E. Henneman, Jr.; Gregory P. Gibson; Henneman & Associates, PLC

(57) ABSTRACT

A novel sheet material dispenser package includes a first sidewall, a second sidewall, a collapsible top wall, a collapsible bottom wall, a first hinge feature, and a second hinge feature. A first side region of the first sidewall is coupled to a first region of the second sidewall via the first hinge feature and a second side region of the first sidewall is coupled to a second side region of the second sidewall via the second hinge feature. The top wall includes a first region coupled to the first sidewall and a second region coupled to the second sidewall. The bottom wall includes a first region coupled to the first sidewall and a second region coupled to the second sidewall. In a particular embodiment, the sheet material dispenser is a collapsible tissue dispenser adapted to sit in a cup holder when in a non-collapsed state and in a pocket when in a collapsed state.

24 Claims, 7 Drawing Sheets

FLEXIBLE SHEET MATERIAL DISPENSER

RELATED APPLICATIONS

This application is a continuation of co-pending U.S. patent application Ser. No. 13/155,880 entitled "Flexible Sheet Material Dispenser," filed Jun. 8, 2011 by the same inventor, which claims the benefit of U.S. Provisional Patent Application No. 61/352,522 entitled "Flexible Paper Dispenser," filed Jun. 8, 2010 by the same inventor, both of which are incorporated herein by reference in their respective entireties.

BACKGROUND OF THE INVENTION

1. Field of the Invention

This invention relates generally to disposable sheet materials, and more particularly to disposable sheet material dispenser packages.

2. Description of the Background Art

Modern society has grown accustomed to the convenience of using disposable sheet material such as, for example, tissues, moist towelettes, paper towels, etc. Oftentimes, disposable sheets are packaged in a portable manner so as to provide easy access during travel. For example, tissues are commonly packaged in small plastic bags that can be kept in vehicles, purses, pockets, etc. Typically, the bag encloses a small stack of tissues that overlap one another to facilitate the dispensing of one tissue at a time. Moist towelettes are often packaged in more elaborate bags and/or small rigid packages with a sealable lid so as to prevent the towelettes from drying out.

Although conventional sheet material packages provide some degree of portability, there are several disadvantages. For example, both hands are required to remove tissues from conventional plastic bag packaging. That is, one hand is required to grasp the package while the other is required to pull the sheet from the package. Of course, this can be particularly difficult in situations (e.g. driving) wherein one hand is preoccupied. As another example, rigid packages are typically bulky and, therefore, inconvenient to carry. Of course, rigid packages typically occupy a great deal of space and are, therefore, inconvenient to ship in large numbers. As yet another example, conventional packaging is oftentimes hazardous to the environment.

What is needed, therefore, is a disposable sheet material dispenser package with improved portability and versatility. What is also needed is a disposable sheet material dispenser package that facilitates easier sheet removal. What is also needed is a disposable sheet material dispenser package that is more environmentally safe.

SUMMARY

The present invention overcomes the problems associated with the prior art by providing a disposable sheet material dispenser package that requires the use of only one hand to remove a sheet and can be at least partially collapsed or compressed to fit within and/or frictionally engage receptacles for increased portability.

The disposable sheet material dispenser includes a first flexible sidewall, a second flexible sidewall, a collapsible top wall, a collapsible bottom wall, a first hinge feature, and a second hinge feature. The first sidewall includes top region, a bottom region, a first side region, and a second side region. The second sidewall includes top region, a bottom region, a first side region, and a second side region. The top wall includes a first region, a second region, and an aperture through which sheet material is dispensed. The first region of the top wall is coupled to the top region of the first sidewall and the second region of the top wall is coupled to the top region of the second sidewall. The bottom wall includes a first region and a second region. The first region of the bottom wall is coupled to the bottom region of the first sidewall and the second region of the bottom wall is coupled to the bottom region of the second wall. The first hinge feature couples the first side region of the first sidewall to the first side region of the second sidewall. The second hinge feature couples the second side region of the first sidewall to the second side region of the second sidewall.

In a particular embodiment, the first sidewall, the second sidewall, the top wall, and the bottom wall are formed from the same single sheet of material.

In one example embodiment, the first side region of the first sidewall and the first side region of the second sidewall are contiguous, and the first hinge feature includes a crease formed between the first side region of the first sidewall and the first side region of the second sidewall. In addition, the second side region of the first sidewall and the second side region of the second sidewall are contiguous, and the second hinge feature includes a crease formed between the second side region of the first sidewall and the second side region of the second sidewall. The first side region of the second sidewall is fastened to the second side region of the second sidewall. In this example embodiment, the top region of the first sidewall and the first side region of the top wall are contiguous, and the second region of the top wall is fastened to the top region of the second sidewall. The bottom region of the first sidewall and the first side region of the bottom wall are contiguous, and the second region of the bottom wall is fastened to the bottom region of the second sidewall.

In another example embodiment, the first side region of the first sidewall and the first side region of the second sidewall are contiguous, and the first hinge feature includes at least one crease formed between the first side region of the first sidewall and the first side region of the second sidewall. The second side region of the first sidewall is fastened to the second side region of the second sidewall. The first region of the top wall and the top region of the first sidewall are contiguous, and the second region of the top wall is be fastened to the top region of the second sidewall. As an option, the first region of the bottom wall and the bottom region of the first sidewall can be contiguous, and the second region of the bottom wall can be fastened to the bottom region of the second sidewall. Alternatively, the first region of the bottom wall can be fastened to the bottom region of the first sidewall, and the second region of the bottom wall and the bottom region of the second sidewall can be contiguous.

In yet another example embodiment, the first region of the top wall and the top region of the first sidewall are contiguous, and the second region of the top wall and the top region of the second sidewall are contiguous. The first region of the top wall is fastened to the second region of the top wall. In addition, the first region of the bottom wall and the bottom region of the first sidewall are contiguous, the second region of the bottom wall and the bottom region of the second sidewall are contiguous, and the first region of the bottom wall is fastened to the second region of the bottom wall.

In another example embodiment, the first side region of the first sidewall is fastened to the first side region of the second sidewall, and the second side region of the first sidewall is fastened to the second side region of the second sidewall. In a more particular embodiment, the first region of the top wall and the top region of the first sidewall are contiguous, the first region of the bottom wall and the bottom region of the first sidewall are contiguous, and the second sidewall and at least one of the top wall and the bottom wall are contiguous. In one optional dispenser package layout, the second sidewall and one of the top wall and the bottom wall are contiguous, while the other of the top wall and the bottom wall are fastened to the second sidewall. In a slightly different embodiment, the first region of the top wall and the top region of the first sidewall are contiguous, the second region of the top wall and the top region of the second sidewall are contiguous, the first region of the bottom wall and the bottom region of the first sidewall are contiguous, and the second region of the bottom wall and the bottom region of the second sidewall are contiguous. Furthermore, the first region of the top wall is fastened to the second region of the top wall while the first region of the bottom wall and the second region of the bottom wall are contiguous. In alternate embodiment, the first region of the bottom wall is fastened to the second region of the bottom wall, and the first region of the top wall and the second region of the top wall are contiguous. In a different alternate embodiment, the first region of the top wall and the second region of the top wall are contiguous, the first region of the bottom wall and the second region of the bottom wall are contiguous, and the top region of the second sidewall and the bottom region of the second sidewall are fastened together.

In another embodiment, the first sidewall and the second sidewall are operative to deflect away from one another in response to the first side region of the first sidewall and the first side region of the second wall being urged toward the second side region of the first sidewall and the second side region of the second sidewall (e.g., squeezing the dispenser from the sides). Moreover, the first sidewall and the second sidewall are operative to regain shape in response to the forces on the first side region of the first sidewall and the first side region of the second wall being relaxed. In a more particular embodiment, the top wall and the bottom wall unfold when the first sidewall and the second sidewall are deflected away from one another, and the top wall and the bottom wall fold when the first sidewall and the second sidewall are drawn toward one another. In an even more particular embodiment, the top wall folds away from both the first sidewall and the second sidewall (e.g., outward) when the first sidewall and the second sidewall are drawn toward one another. The bottom wall folds toward the first sidewall and the second sidewall (e.g., inward) when the first sidewall and the second sidewall are drawn toward one another. Alternatively, the bottom wall folds away from both the first sidewall and the second sidewall when the first sidewall and the second sidewall are drawn toward one another, and the top wall folds toward both the first sidewall and the second sidewall when the first sidewall and the second sidewall are drawn toward one another.

In a particular example embodiment, the sheet material dispenser package also includes a third hinge feature coupling the top region of the first sidewall to the first region of the top wall, a fourth hinge feature coupling the top region of the second sidewall to the second region of the top wall, a fifth hinge feature coupling the first region of the top wall to the second region of the top wall, a sixth hinge feature coupling the bottom region of the first sidewall to the first region of the bottom wall, a seventh hinge feature coupling bottom region of the second sidewall to the second region of the bottom wall, and an eighth hinge feature coupling the first region of the bottom wall to the second region of the bottom wall. Furthermore, the first hinge feature, the second hinge feature, the fifth hinge feature, and the eighth hinge feature are coplanar when the first sidewall and the second sidewall are deflected away from one another and when the first sidewall and the second sidewall are relaxed.

In a particular embodiment, the sheet material dispenser package is a tissue dispenser package. Alternatively, the sheet material dispenser package is a moist wipe dispenser package.

In another embodiment, the sheet dispenser package is adapted to be fixably seated within a recess. That is, the first side region of the first sidewall and the first side region of the second sidewall are adapted to engage a first inner surface of the recess, and the second side region of the first sidewall and the second side region of the second sidewall are adapted to engage an opposite second inner surface of the recess. Furthermore, the distance between the first hinge feature and the second hinge feature is greater than the distance between the first inner surface of the recess and the second inner surface of the recess when the dispenser package is in a collapsed state. In a more particular embodiment, the dispenser package further includes a grip feature adapted to frictionally engage the first inner surface of the recess and the second inner surface of the recess. In another more particular embodiment, the recess is a cup holder.

BRIEF DESCRIPTION OF THE DRAWINGS

The present invention is described with reference to the following drawings, wherein like reference numbers denote substantially similar elements.

DETAILED DESCRIPTION

The present invention overcomes the problems associated with the prior art, by providing a disposable sheet material dispenser that can be fixably seated in a recess and can be collapsed for increased portability. In the following description, numerous specific details are set forth (e.g., sheet material types, blank shape, etc.) in order to provide a thorough understanding of the invention. Those skilled in the art will recognize, however, that the invention may be practiced apart from these specific details. In other instances, details of well known paperboard manufacturing practices (e.g., stamping, printing, joint fastening, etc.) and components have been omitted, so as not to unnecessarily obscure the present invention.

Figure 1A:
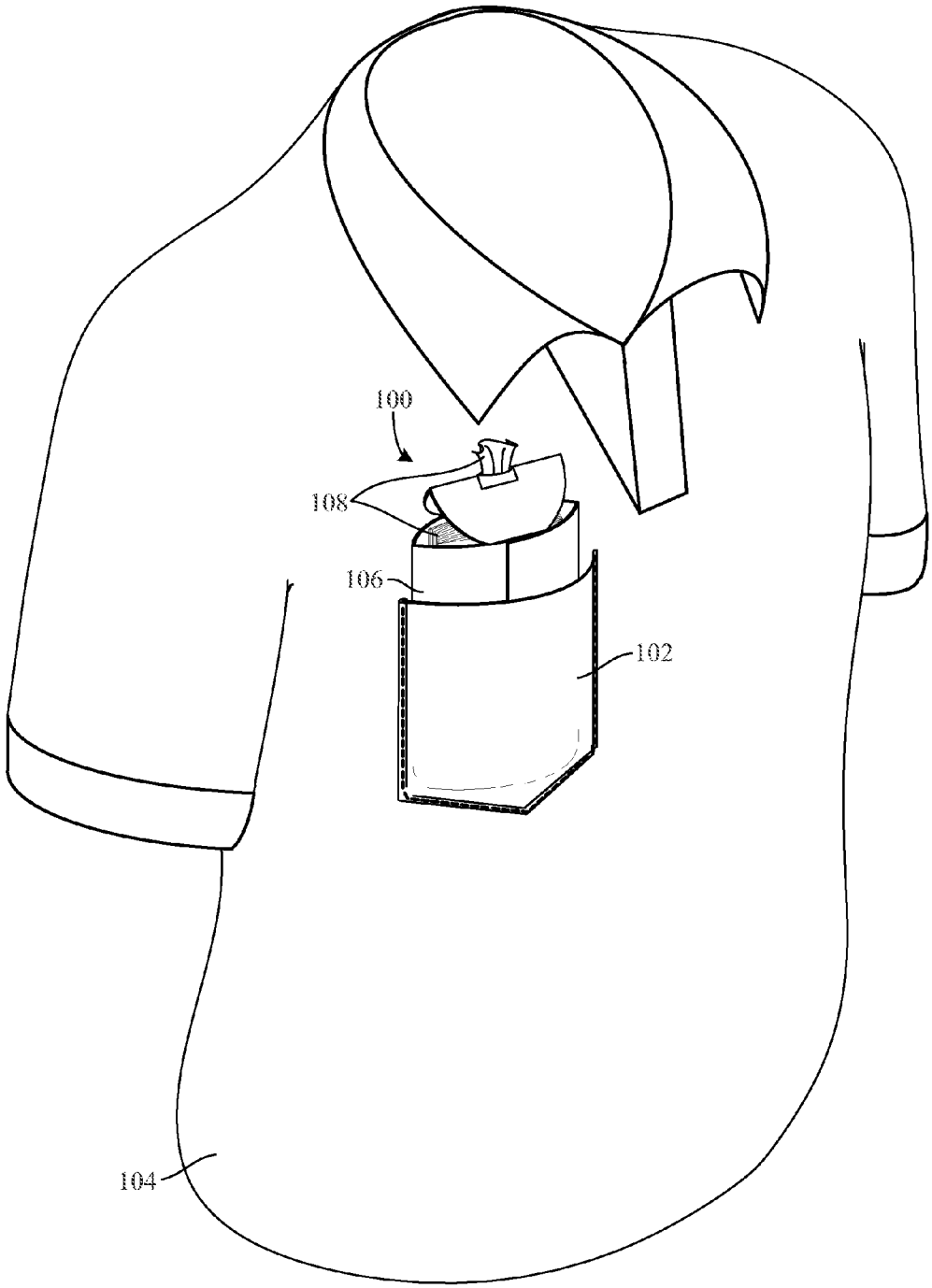
FIG. 1A is a perspective view of a disposable sheet material dispenser 100 positioned in a front pocket of a shirt.

FIG. 1A is a perspective view of a disposable sheet material dispenser 100 positioned in a front pocket 102 of a shirt 104. Dispenser 100 includes a dispenser package 106 enclosing a plurality of disposable sheets 108. In this particular embodiment, sheets 108 are tissues and, therefore, dispenser 100 is a portable tissue dispenser. Package 106 can function in either a collapsed state or a non-collapsed state. As shown, package 106 is in a collapsed state wherein dispenser 100 can be easily carried in pocket 102 or any other suitable receptacle (e.g., purse, vehicle glove box, briefcase, etc.) without occupying a great deal of space.

Although sheets 108 are illustrated as being tissues, those skilled in the art will recognize that the invention can be practiced with any type of sheet material wherein portable packaging is desirable. For example, sheets 108 could be paper towels, moist wipes, fabric softener sheets, etc. Depending on the particular application, sheets 108 can be prepackaged in, for example, a thin plastic protective membrane. As an alternative, package 106 can be lined with a thin plastic membrane. In applications where sheets 108 are of the dry type (e.g., paper towels, tissues, fabric softener sheets, etc), such a membrane may not always be necessary. In applications were sheets 108 are of the moist type (e.g., wet wipes), it is likely that some type of prepackaging would be used to provide a moisture barrier. Although not shown, sheets 108 are precut individual tissues that are arranged in overlapping stacked relationship wherein the removal of one sheet pulls the following sheet into position for subsequent removal. Optionally, sheets 108 could be a continuous roll of sheet material that dispenses from the center-out. The individual sheets of the role could be singulated via preformed perforated lines that allow each sheet to be torn from the rest of the roll. As another option for singulation of the sheet material, dispenser 100 could include a cutting feature that allows sheets of any desirable length to be cut from the role.

Figure 1B:
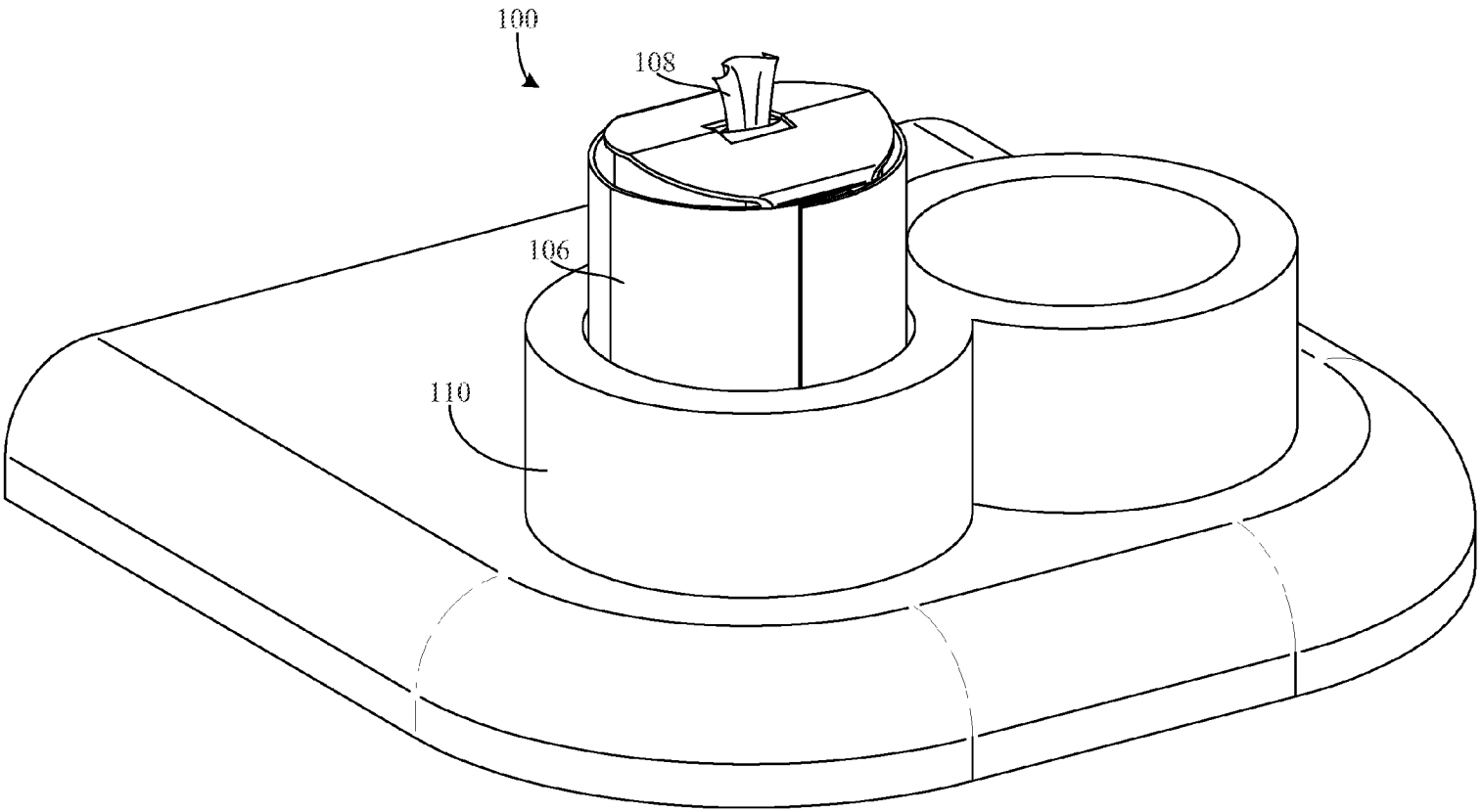
FIG. 1B is a perspective view of the dispenser 100 of FIG. 1A seated in a cup holder.

FIG. 1B is a perspective view of dispenser 100 shown seated in a cup holder 400 wherein package 106 is in a non-collapsed state. Package 106 is constructed from relatively stiff and flexible material such that it has a natural tendency to return to a collapsed state. However, when seated within a recess such as cup holder 110, package 106 is retained in a non-collapsed state by the interior walls of the recess. When retained in a non-collapsed state, package 106 exerts a biasing force on the interior walls of the recess. As a result, the friction between package 106 and the retaining wall is sufficient to secure package 106 in a fixed position while sheets 108 are being removed. Accordingly, the removal of sheets 108 from dispenser 100 requires the use of only one hand. Of course, this is particularly desirable to users in situations (i.e. operating a vehicle) wherein one hand is preoccupied.

Figure 2B:
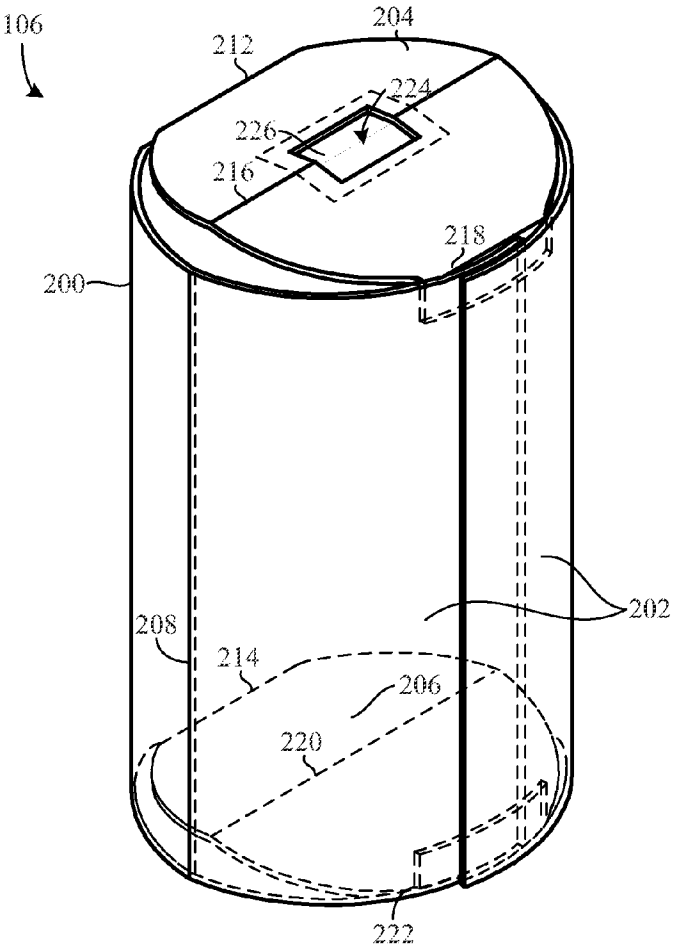
FIG. 2B is a perspective view of package 106 of shown in a non-collapsed state.
Figure 2A:
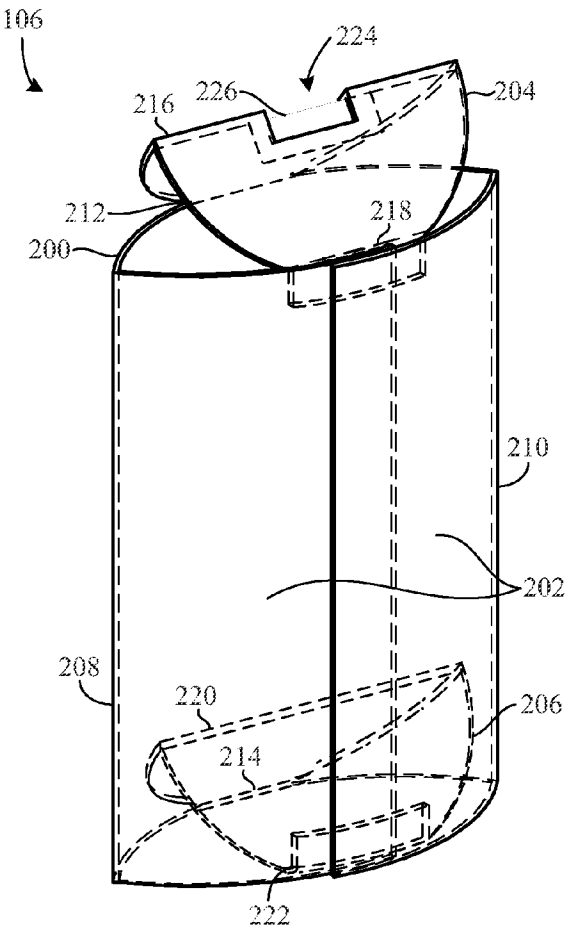
FIG. 2A is a perspective view of a package 106 of the dispenser 100 of FIG. 1A shown in a collapsed state.

FIG. 2A is a perspective view of package 106 shown in a collapsed state. Package 106 includes a first sidewall 200, an opposite second sidewall 202, a top wall 204, a bottom wall 206, a first hinge feature 208, a second hinge feature 210, third hinge feature 212, a fourth hinge feature 214, a fifth hinge feature 216, a sixth hinge feature 218, a seventh hinge feature 220, an eighth hinge feature 222, an aperture 224, and a drag feature 226. First sidewall 200 is coupled to second sidewall 202 via first hinge feature 208 and second hinge feature 210. Furthermore, first sidewall 200 is coupled to top wall 204 and bottom wall 206 via third hinge feature 212 and fourth hinge feature 214, respectively. Similarly, second sidewall 202 is coupled to top wall 204 and bottom wall 206 via sixth hinge feature 218 and eighth hinge feature 222, respectively. Fifth hinge feature 216 enables top wall 204 to fold when package 106 is transitioned from a non-collapsed state to a collapsed state. Oppositely, fifth hinge feature 216 enables top wall 204 to unfold as package 106 is transitioned from a collapsed state to a non-collapsed state. Seventh hinge feature 220 enables bottom wall 206 to fold when package 106 is transitioned from a non-collapsed state to a collapsed state. Oppositely, seventh hinge feature 220 enables bottom wall 204 to unfold as package 106 is transitioned from a collapsed state to a non-collapsed state. As shown, package 106 is in a collapsed state wherein first sidewall 200 and second sidewall 202 are relaxed such that both top wall 204 and bottom wall 206 are folded. That is, top wall 204 is folded upward in a direction facing away from sidewalls 200 and 202, and bottom wall 206 is folded upward in a direction facing toward sidewalls 200.

Aperture 224 is an opening through which sheets 108 are dispensed from package 106. Drag feature 226 is a thin perforated membrane that is aligned with aperture 224 and fixed to the interior surface of top wall 204 by, for example, an adhesive disposed around the peripheral region of aperture 224. As sheets 108 are pulled through aperture 224, they are also pulled through drag feature 226, which exerts a small amount of opposing force on sheets 106 passing therethrough. The purpose of drag feature 226 is to facilitate "one-at-a-time" dispensing of sheets 208.

FIG. 2B is a perspective view of package 106 shown in a non-collapsed state. Package 106 is transitioned from a collapsed state to a non-collapsed state by urging first hinge feature 208 and second hinge feature 210 toward one another. As hinge features 208 and 210 are displaced inward, first sidewall 200 and second sidewall 202 respond by deflecting away from one another. As sidewalls 200 and 202 deflect outward, top wall 204 and bottom wall 206 unfold. The stiffness and elasticity of package 106 is such that when the forces urging hinge features 208 and 210 toward one another are relaxed, package 106 transitions back to a collapsed state without suffering any permanent deformation. Accordingly, dispenser 100 can withstand frequent transitions between the collapsed state and non-collapsed state.

Figure 3A:
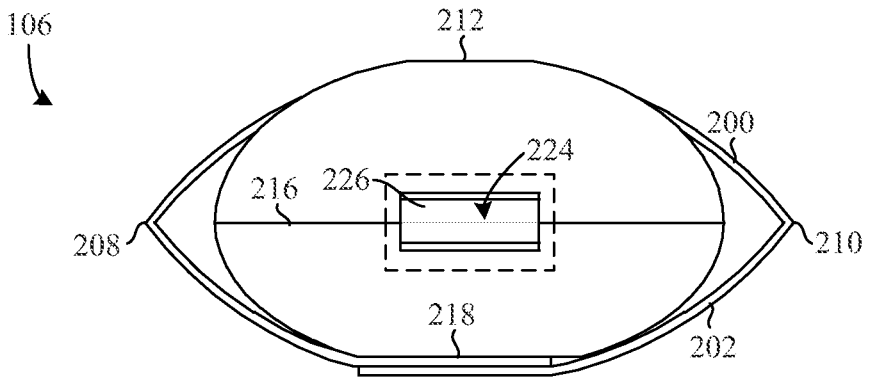
FIG. 3A is a top view of package 106 shown in a collapsed state.

FIG. 3A is a top view of package 106 shown in a collapsed state. One important aspect of the present invention is that hinge features 208, 210, 216, and 220 lie in a common plane. This is particularly important because it allows package 106 to be very thin and, therefore, portable when in a collapsed state. It also provides for very simple, yet effective, means for transitioning package 106 from a collapsed state to a non-collapsed state.

It is important to understand that when package 106 is in a collapsed state, the outward deflection in sidewalls 200 and 202 depends on the number and/or ply of sheets 108 disposed therebetween. That is, the deflection in sidewalls 200 increases proportionally with the number and thickness of sheets in package 106. Ordinarily, sidewalls 200 and 202 would not be deflected when package 106 is in collapsed state and no sheets are present. However, for illustrative purposes, package 106 is shown slightly bulged as if sheets 108 were present.

Figure 3B:
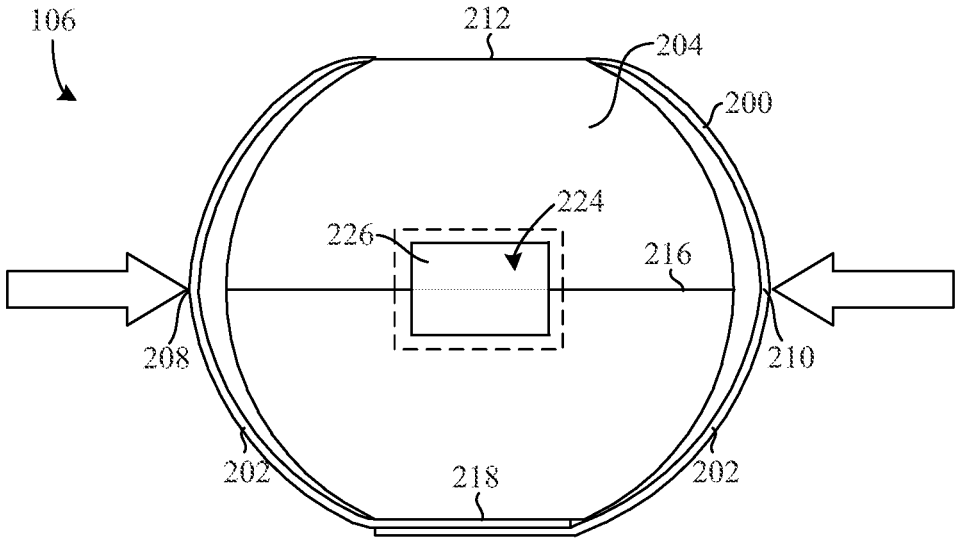
FIG. 3B is a top view of package 106 shown in a non-collapsed state.

FIG. 3B is a top view of package 106 shown in a non-collapsed state wherein hinge features 208 and 210 are being urged toward one another. In reference to the previous figures, it can be seen that the diameter of cup holder 110 is less than the distance between first hinge feature 208 and second hinge feature 210 when package 106 is in a collapsed state. Accordingly, hinge feature 208 has to be urged toward hinge feature 210 in order for package 106 to fit within cup holder 110. This assures that elastic restore force of package 106 is sufficient to fixably engage the inner surface of cup holder 110 while sheets 108 are dispensed. Although not shown, package 106 could also include some suitable type of friction promoting feature formed or fastened on or around hinge features 208 and 210. For example, adhesively backed strips of grit material and/or textured rubber could be fastened to package 106 directly over hinge regions 208 and 210.

Figure 4B:
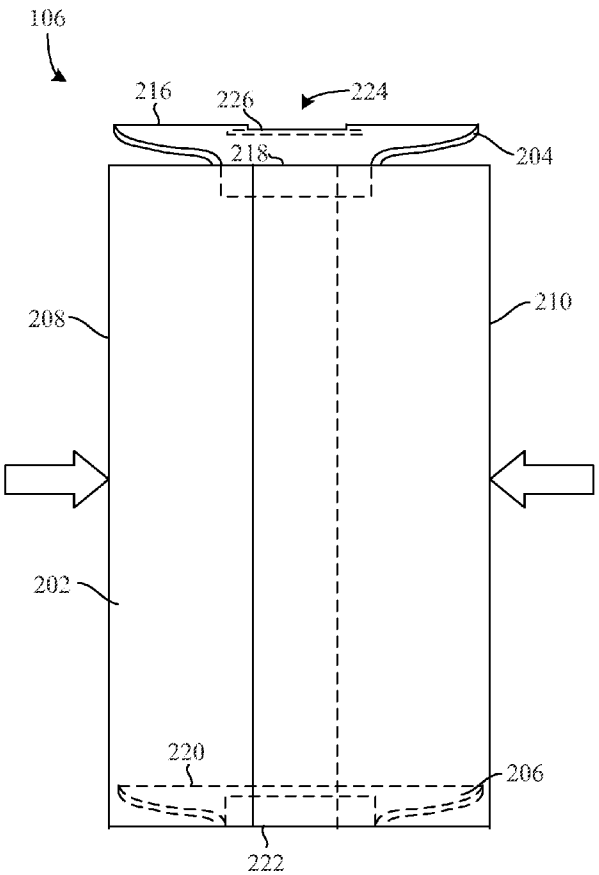
FIG. 4B is a side view of package 106 shown in a non-collapsed state.
Figure 4A:
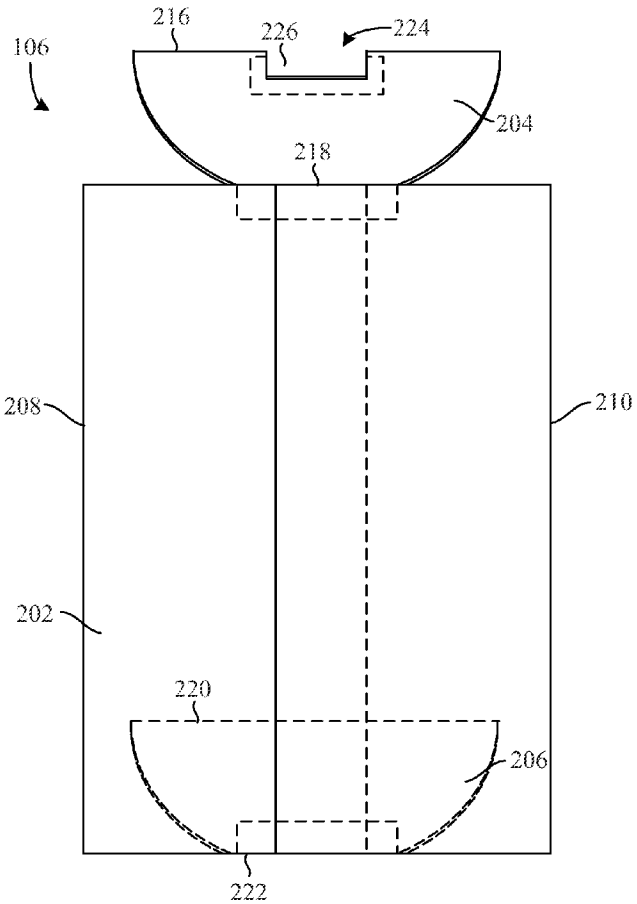
FIG. 4A is a side view of package 106 shown in a collapsed state.

FIG. 4A is a side view of package 106 shown in a collapsed state wherein top wall 204 and bottom wall 206 are folded. In this particular embodiment, the distance between top wall 204 and bottom wall 206 remains the same regardless if package 106 is in a collapsed state or a non-collapsed state. As package 106 transitions to a collapsed state from a non-collapsed state, the relative position of sheets 108 with respect to top wall 204 remains consistent. For example, as top wall 204 folds upward, sheets 108 are simultaneously lifted in the same direction by the folding of bottom wall 206.

FIG. 4B is a side view of package 106 shown in a non-collapsed state wherein top wall 204 and bottom wall 206 are unfolded. Although not shown, package 106 could also include a fastening feature for attaching dispenser 100 to various surfaces. For example, one side of a hook and loop fastener could be adhered the exterior surface of bottom wall 206 while the other side of the hook and loop fastener could be adhered to any type of surface desired by the user. For example, the other side of the hook and loop fastener could be adhered to the bottom inner surface of cup holder 110 so as to insure dispenser 100 is securely mounted therein. As another option, the other side of the hook and loop fastener could be adhered to a flat open surface such that coupling both sides of the fastener together forces bottom wall 206 to remain unfolded. By forcing bottom wall 206 to remain unfolded, package 106 would be held in a non-collapsed position without the need to urge hinge features 208 and 210 toward one another. Accordingly, package 106 could remain in a non-collapsed state without being seated in a recess (i.e. cup holder). Alternatively, the same functions provided by the hook and loop fastener could be achieved using other suitable fasteners such as, for example, double sided tape.

Figure 5:
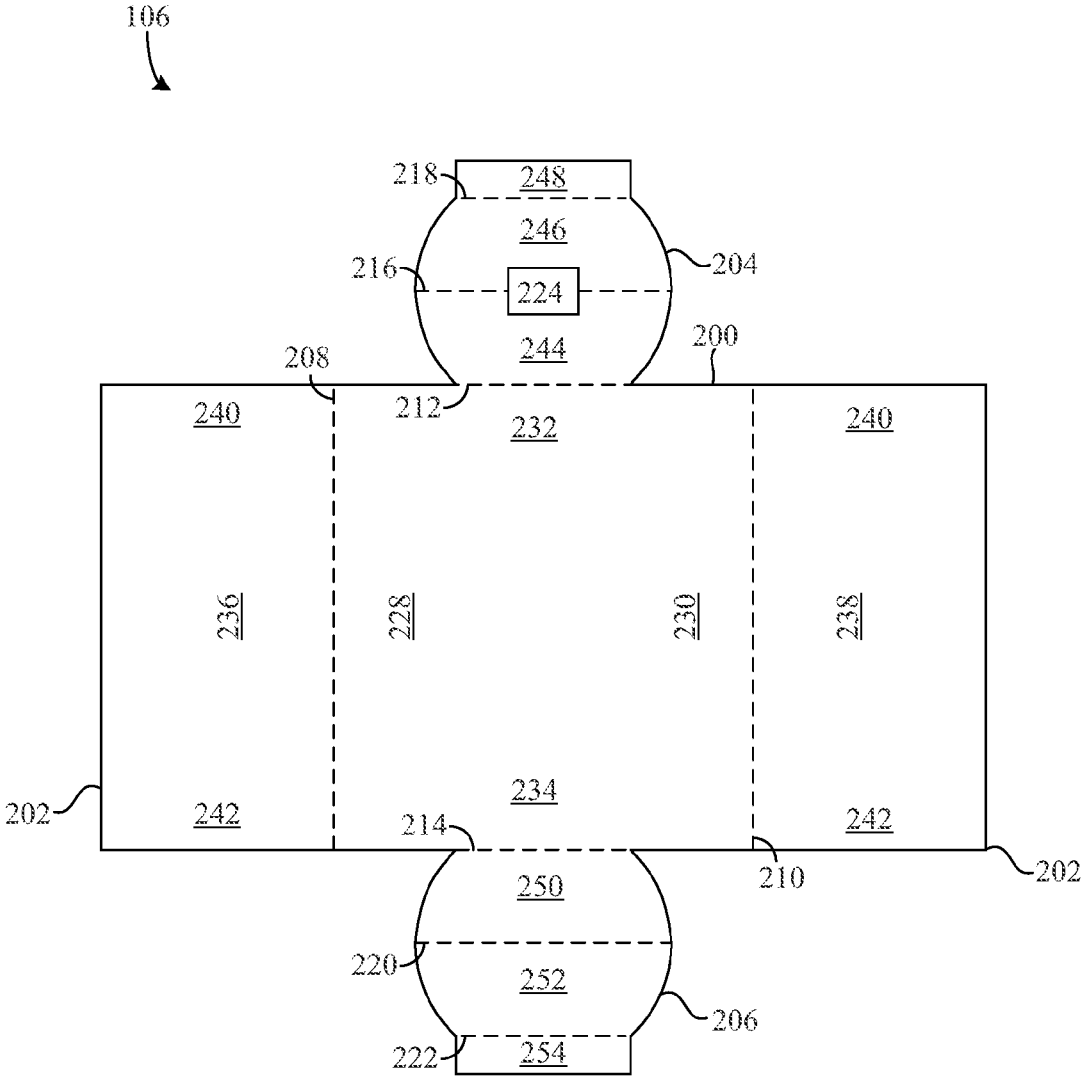
FIG. 5 is a front view of package 106 shown disassembled.

FIG. 5 is a front view of package 106 shown disassembled. In this particular embodiment, package 106 is constructed from a single paperboard blank that is formed by some suitable means such as, for example, stamping. Although it is not essential to the present invention, the inventor has found that constructing package 106 from paperboard is a suitable option in many applications.

In this particular embodiment, first sidewall 200, second sidewall 202, top wall 204, and bottom wall 206 are integral regions of a single piece of material. First sidewall 200 includes a first side region 228, a second side region 230, a top region 232, and a bottom region 234. Second sidewall 202 includes a first side region 236, a second side region 238, a top region 240, and a bottom region 242. Top wall 204 includes a first region 244 and a second region 246. Second region 246 of top wall 204 includes a flap 248 that facilitates the fastening of second region 246 of top wall 204 to top region 240 of second sidewall 202. Bottom wall 206 includes a first region 250 and a second region 252. Second region 252 of bottom wall 206 includes a flap 254 that facilitates the fastening of second region 252 of bottom wall 206 to bottom region 242 of second sidewall 202. Those skilled in the art will recognize that flaps 248 and 254 can be fastened to top region 240 and bottom region 242, respectively, of second sidewall 202 via any suitable means such as, for example, glue, tape, etc.

First hinge feature 208 couples first side region 228 of first sidewall 200 to first side region 236 of second sidewall 202. First hinge feature 208 is a fold line (e.g., score line, crease, perforated line, etc.) formed between first side region 228 of first sidewall 200 and first side region 236 of second sidewall 202. Accordingly, first side region 228 of first sidewall 200 and first side region 236 of second sidewall 202 are contiguous to one another. In other words, first side region 228 of first sidewall 200 and first side region 236 of second sidewall 202 are formed from respective adjacent regions of a single sheet wherein the sheet material makes a seamless transition therebetween.

Second hinge feature 210 couples second side region 230 of first sidewall 200 to second side region 238 of second sidewall 202. Second hinge feature 210 is a fold line formed between second side region 230 of first sidewall 200 and second side region 238 of second sidewall 202. Accordingly, second side region 230 of first sidewall 200 and second side region 238 of second sidewall 202 are contiguous to one another.

Third hinge feature 212 couples top region 232 of first sidewall 200 to first region 244 of top wall 204. Third hinge feature 212 is a fold line formed between top region 232 of first sidewall 200 and first region 244 of top wall 204. Accordingly, top region 232 of first sidewall 200 and first region 244 of top wall 204 are contiguous to one another.

Fourth hinge feature 214 couples bottom region 234 of first sidewall 200 to first region 250 of bottom wall 206. Fourth hinge feature 214 is a fold line formed between bottom region 234 of first sidewall 200 and first region 250 of bottom wall 206. Accordingly, bottom region 234 of first sidewall 200 and first region 250 of bottom wall 206 are contiguous to one another.

Fifth hinge feature 216 couples first region 244 of top wall 204 to second region 246 of top wall 204. Fifth hinge feature 216 is a fold line formed between first region 244 of top wall 204 and second region 246 of top wall 204. Accordingly, first region 244 and second region 246 of top wall 204 are contiguous to one another.

Sixth hinge feature 218 couples second region 246 of top wall 204 to flap 248 of top wall 204. Sixth hinge feature 218 is a fold line formed between second region 246 of top wall 204 and flap 248 of top wall 204. Accordingly, second region 246 of top wall 204 and flap 248 of top wall 204 are contiguous to one another.

Seventh hinge feature 220 couples first region 250 of bottom wall 206 to second region 252 of bottom wall 206. Seventh hinge feature 220 is a fold line formed between first region 250 and second region 252 of bottom wall 206. Accordingly, first region 250 and second region 252 of bottom wall 206 are contiguous to one another.

Eighth hinge feature 222 couples second region 252 of bottom wall 206 to flap 254 of bottom wall 206. Eighth hinge feature 222 is a fold line formed between second region 252 of bottom wall 206 and flap 254 of bottom wall 206. Accordingly, second region 252 of bottom wall 206 and flap 254 of bottom wall 206 are contiguous to one another.

Figure 6:
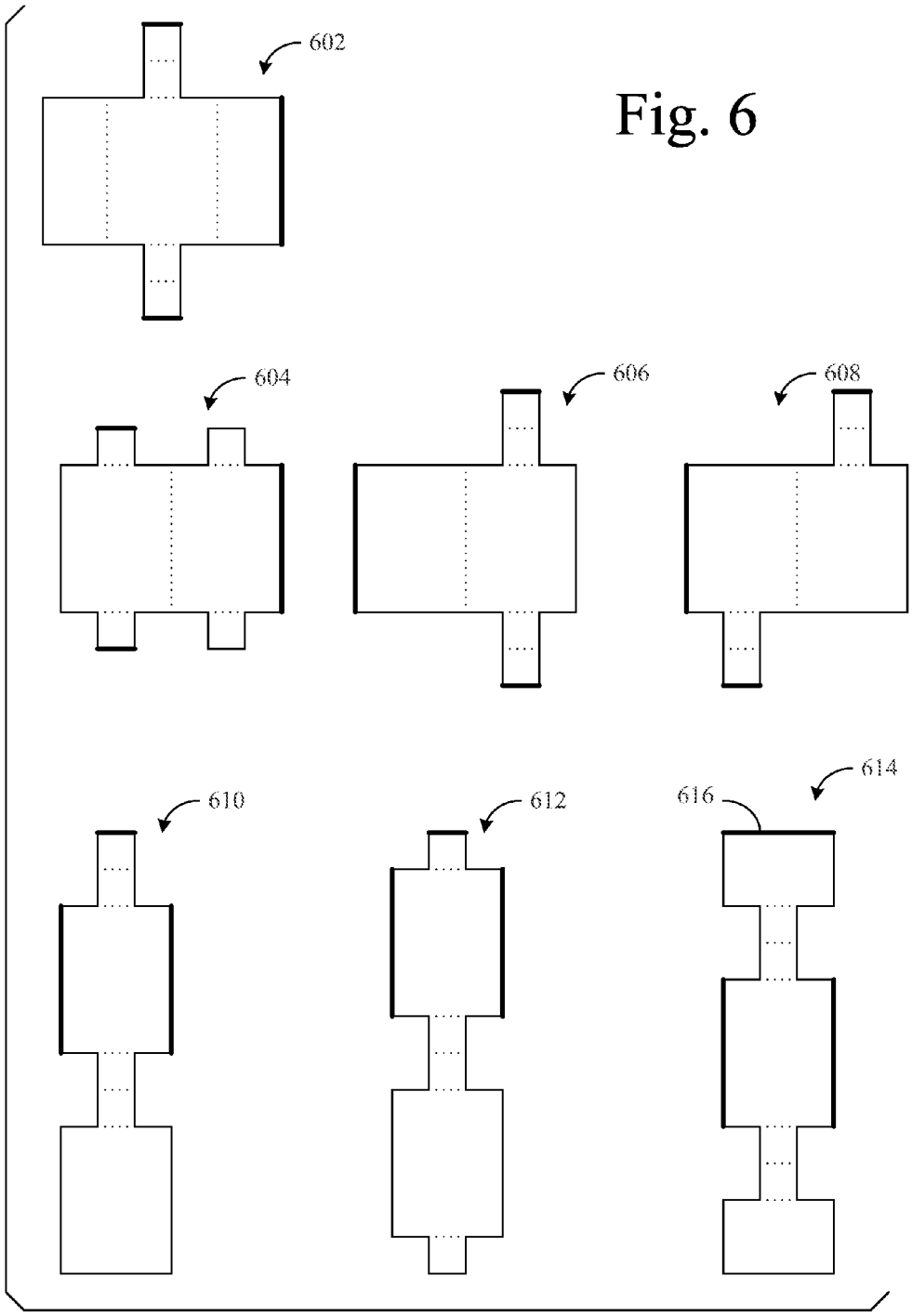
FIG. 6 is a representational diagram showing shapes of alternative blanks, each capable of forming a dispenser from a single sheet of material.

FIG. 6 is a representational diagram showing several (7) innovative configurations for manufacturing dispensers of the present invention from a single sheet of material. The dark lines in FIG. 6 represent tabs, adhesive lines, or the like used to form seams between adjacent edges of the sheet material. The top and bottom walls are shown representationally as rectangular strips. However, the top and bottom walls can have any desirable shape. In addition, the dispensing apertures are omitted, so as not to unnecessarily obscure the basic principles illustrated by the drawings. The dashed lines represent fold lines that form hinge features of the various dispensers. Blank 602 includes three (3) adhesive lines and six (6) fold lines. The resulting dispenser will include eight hinge features, one along each fold line and one along each of the top and bottom adhesive lines. Similarly, blanks 604, 606, 608, 610, 612, and 614 all include no more than three (3) adhesive lines. Indeed, blanks 604, 606, 608, 610, 612, and 614 all include exactly three (3) adhesive lines, except that blank 614 includes one optional adhesive line 616. Importantly, blank 614 could be formed into a functional dispenser using only two (2) adhesive lines. Blanks 604, 606, 608, 610, and 612 all include five (5) fold lines, and blank 614 includes 6 fold lines. All of the blanks, when assembled into a dispenser, will include eight (8) hinge features.

The description of particular embodiments of the present invention is now complete. Many of the described features may be substituted, altered or omitted without departing from the scope of the invention. For example, alternate types of sheet material (e.g., paper towel, wet wipes, etc.), may be substituted for the tissues 108. As another example, package 106 could be constructed from any suitable material including, but not limited to, biodegradable paperboard, thin plastic, etc. As yet another example, various suitable blank patterns can be used to construct package 106. These and other deviations from the particular embodiments shown will be apparent to those skilled in the art, particularly in view of the foregoing disclosure.

I claim:

1. A collapsible sheet material dispenser package comprising:

a first flexible sidewall including a top region, a bottom region opposite said top region, a first side region and a second side region opposite said first side region;

a second flexible sidewall opposite said first sidewall, said second sidewall having a top region, a bottom region opposite said top region of said second sidewall, a first side region, and a second side region opposite said first side region of said second sidewall;

a collapsible top wall including a first region and a second region opposite said first region of said top wall, said first region of said top wall being coupled to said top region of said first sidewall, said second region of said top wall being coupled to said top region of said second sidewall, said collapsible top wall defining an aperture through which sheet material can be dispensed;

a collapsible bottom wall, said collapsible bottom wall having a first region and a second region opposite said first region of said bottom wall, said first region of said bottom wall being coupled to said bottom region of said first sidewall, said second region of said bottom wall being coupled to said bottom region of said second sidewall;

a first hinge feature coupling said first side region of said first sidewall to said first side region of said second sidewall; and a second hinge feature coupling said second side region of said first sidewall to said second side region of said second sidewall.

2. The sheet material dispenser package of claim 1, wherein said first sidewall, said second sidewall, said top wall, and said bottom wall are formed from a single sheet of material.

3. A sheet material dispenser package according to claim 2, wherein:

said first side region of said first sidewall and said first side region of said second sidewall are contiguous, said first hinge feature including at least one crease formed between said first side region of said first sidewall and said first side region of said second sidewall;

said second side region of said first sidewall and said second side region of said second sidewall are contiguous, said second hinge feature including at least one crease formed between said second side region of said first sidewall and said second side region of said second sidewall;

said first side region of said second sidewall is fastened to said second side region of said second sidewall;

said top region of said first sidewall and said first side region of said top wall are contiguous;

said second region of said top wall is fastened to said top region of said second sidewall;

said bottom region of said first sidewall and said first side region of said bottom wall are contiguous; and said second region of said bottom wall is fastened to said bottom region of said second sidewall.

4. A sheet material dispenser package according to claim 2, wherein said first side region of said first sidewall and said first side region of said second sidewall are contiguous, said first hinge feature including at least one crease formed between said first side region of said first sidewall and said first side region of said second sidewall, and said second side region of said first sidewall is fastened to said second side region of said second sidewall.

5. A sheet material dispenser package according to claim 4, wherein said first region of said top wall and said top region of said first sidewall are contiguous, and said second region of said top wall is fastened to said top region of said second sidewall.

6. A sheet material dispenser package according to claim 5, wherein said first region of said bottom wall and said bottom region of said first sidewall are contiguous, and said second region of said bottom wall is fastened to said bottom region of said second sidewall.

7. A sheet material dispenser package according to claim 5, wherein said first region of said bottom wall is fastened to said bottom region of said first sidewall, and said second region of said bottom wall and said bottom region of said second sidewall are contiguous.

8. A sheet material dispenser package according to claim 4, wherein said first region of said top wall and said top region of said first sidewall are contiguous;

said second region of said top wall and said top region of said second sidewall are contiguous;

said first region of said top wall is fastened to said second region of said top wall;

said first region of said bottom wall and said bottom region of said first sidewall are contiguous;

said second region of said bottom wall and said bottom region of said second sidewall are contiguous; and said first region of said bottom wall is fastened to said second region of said bottom wall.

9. A sheet material dispenser package according to claim 2, wherein said first side region of said first sidewall is fastened to said first side region of said second sidewall, and said second side region of said first sidewall is fastened to said second side region of said second sidewall.

10. A sheet material dispenser package according to claim 9, wherein said first region of said top wall and said top region of said first sidewall are contiguous;

said first region of said bottom wall and said bottom region of said first sidewall are contiguous;

said second sidewall and at least one of said top wall and said bottom wall are contiguous.

11. A sheet material dispenser package according to claim 10, wherein said second sidewall and one of said top wall and said bottom wall are contiguous, the other of said top wall and said bottom wall being fastened to said second sidewall.

12. A sheet material dispenser package according to claim 10, wherein said first region of said top wall and said top region of said first sidewall are contiguous;

said second region of said top wall and said top region of said second sidewall are contiguous;

said first region of said bottom wall and said bottom region of said first sidewall are contiguous; and said second region of said bottom wall and said bottom region of said second sidewall are contiguous.

13. A sheet material dispenser package according to claim 12, wherein said first region of said top wall is fastened to said second region of said top wall, and said first region of said bottom wall and said second region of said bottom wall are contiguous.

14. A sheet material dispenser package according to claim 12, wherein said first region of said bottom wall is fastened to said second region of said bottom wall, and said first region of said top wall and said second region of said top wall are contiguous.

15. A sheet material dispenser package according to claim 12, wherein said first region of said top wall and said second region of said top wall are contiguous;

said first region of said bottom wall and said second region of said bottom wall are contiguous; and said top region of said second sidewall and said bottom region of said second sidewall are fastened together.

16. The sheet material dispenser package of claim 1, wherein said first sidewall and said second sidewall are operative to deflect away from one another responsive to an external force urging said first side region of said first sidewall and said first side region of said second wall toward said second side region of said first sidewall and said second side region of said second sidewall; and said first sidewall and said second sidewall are operative to regain shape responsive to the removal of said external force.

17. The sheet material dispenser package of claim 16, wherein said top wall and said bottom wall unfold when said first sidewall and said second sidewall are deflected away from one another, said top wall and said bottom wall fold when said first sidewall and said second sidewall are drawn toward one another.

18. The sheet material dispenser package of claim 17, wherein said top wall folds away from said first sidewall and said second sidewall when said first sidewall and said second sidewall are drawn toward one another and said bottom wall folds toward said first sidewall and said second sidewall when said first sidewall and said second sidewall are drawn toward one another.

19. The sheet material dispenser package of claim 17, wherein said bottom wall folds away from said first sidewall and said second sidewall when said first sidewall and said second sidewall are drawn toward one another and said top wall folds toward said first sidewall and said second sidewall when said first sidewall and said second sidewall are drawn toward one another.

20. The sheet material dispenser package of claim 17, further comprising:

a third hinge feature coupling said top region of said first sidewall to said first region of said top wall;

a fourth hinge feature coupling top region of said second sidewall to said second region of said top wall;

a fifth hinge feature coupling said first region of said top wall to said second region of said top wall;

a sixth hinge feature coupling said bottom region of said first sidewall to said first region of said bottom wall;

a seventh hinge feature coupling bottom region of said second sidewall to said second region of said bottom wall; and an eighth hinge feature coupling said first region of said bottom wall to said second region of said bottom wall.

21. The sheet material dispenser package of claim 20, wherein said first hinge feature, said second hinge feature, said fifth hinge feature, and said eighth hinge feature are coplanar when said first sidewall and said second sidewall are deflected away from one another and when said first sidewall and said second sidewall are relaxed.

22. The sheet material dispenser package of claim 1, wherein said sheet material dispenser package is a tissue dispenser package.

23. The sheet material dispenser package of claim 1, wherein said sheet material dispenser package is a moist wipe dispenser package.

24. A method for manufacturing a sheet material dispenser package, said method comprising:

forming a first flexible sidewall including a top region, a bottom region opposite said top region, a first side region and a second side region opposite said first side region;

forming a second flexible sidewall opposite said first sidewall, said second sidewall having a top region, a bottom region opposite said top region of said second sidewall, a first side region, and a second side region opposite said first side region of said second sidewall;

forming a collapsible top wall including a first region and a second region opposite said first region of said top wall, said first region of said top wall being coupled to said top region of said first sidewall, said second region of said top wall being coupled to said top region of said second sidewall, said collapsible top wall defining an aperture through which sheet material can be dispensed;

forming a collapsible bottom wall, said collapsible bottom wall having a first region and a second region opposite said first region of said bottom wall, said first region of said bottom wall being coupled to said bottom region of said first sidewall, said second region of said bottom wall being coupled to said bottom region of said second sidewall;

forming a first hinge feature coupling said first side region of said first sidewall to said first side region of said second sidewall; and forming a second hinge feature coupling said second side region of said first sidewall to said second side region of said second sidewall.

* * * * *